US012089720B2

(12) United States Patent
Lim

(10) Patent No.: US 12,089,720 B2
(45) Date of Patent: Sep. 17, 2024

(54) HAIR ACCESSORY

(71) Applicant: Dae Ji Lim, Uijeongbu-si (KR)

(72) Inventor: Dae Ji Lim, Uijeongbu-si (KR)

( * ) Notice: Subject to any disclaimer, the term of this patent is extended or adjusted under 35 U.S.C. 154(b) by 219 days.

(21) Appl. No.: 17/788,337

(22) PCT Filed: Mar. 23, 2021

(86) PCT No.: PCT/KR2021/003553
§ 371 (c)(1),
(2) Date: Jun. 23, 2022

(87) PCT Pub. No.: WO2022/149657
PCT Pub. Date: Jul. 14, 2022

(65) Prior Publication Data

US 2023/0270223 A1 Aug. 31, 2023

(30) Foreign Application Priority Data

Jan. 11, 2021 (KR) ..... 10-2021-0003026

(51) Int. Cl.
*A45D 8/00* (2006.01)
*A45D 8/36* (2006.01)

(52) U.S. Cl.
CPC ..... *A45D 8/004* (2021.01); *A45D 8/36* (2013.01)

(58) Field of Classification Search
CPC ..... A45D 8/00; A45D 8/002; A45D 8/004; A45D 8/006; A45D 8/16; A45D 8/20; A45D 8/22; A45D 8/24; A45D 8/26; A45D 8/28; A45D 8/34; A45D 8/36
See application file for complete search history.

(56) References Cited

U.S. PATENT DOCUMENTS 6,311,699 B1 * 11/2001 Horman ..... A45D 8/34 132/273
6,439,242 B1 * 8/2002 Head ..... A45D 8/34 132/273
2002/0162564 A1 * 11/2002 Head ..... A45D 8/34 132/276

(Continued)

FOREIGN PATENT DOCUMENTS

KR 20-0192512 Y1 8/2000
KR 20-0289117 Y1 9/2002

(Continued)

OTHER PUBLICATIONS

KR101177000B1. Translation (Year: 2012).*
KR100586246B1. Translation (Year: 2006).*

*Primary Examiner* — Cris L. Rodriguez
*Assistant Examiner* — Karim Asqiriba
(74) *Attorney, Agent, or Firm* — KORUS Patent, LLC; Seong Il Jeong

(57) ABSTRACT

A hair accessary according to the present disclosure comprises: a body part including a first body part and a second body part capable of being mutually separated from and coupled to each other; a first decoration part covering at least a portion of an outer surface of the first body part; and a second decoration part covering at least a portion of an outer surface of the second body part; wherein the body part has an inner surface having a closed loop structure formed through coupling of the first body part and the second body part.

9 Claims, 3 Drawing Sheets

(56) References Cited

U.S. PATENT DOCUMENTS

| | | | | |
|---|---|---|---|---|
| 2014/0290682 | A1* | 10/2014 | Wendschuh | A45D 8/34 132/273 |
| 2015/0282584 | A1* | 10/2015 | Boss | A45D 8/34 132/273 |
| 2016/0157569 | A1* | 6/2016 | Ingimundarson | A44C 5/0084 63/1.11 |
| 2016/0249723 | A1* | 9/2016 | Boss | A45D 8/34 132/276 |
| 2017/0181509 | A1* | 6/2017 | Ingimundarson | A44C 5/003 |
| 2017/0224068 | A1* | 8/2017 | Williams | A44C 17/0225 |
| 2019/0285266 | A1* | 9/2019 | Boss | H05B 47/12 |

FOREIGN PATENT DOCUMENTS

| | | | |
|---|---|---|---|
| KR | 10-2004-0103830 | A | 12/2004 |
| KR | 100586246 | B1 * | 6/2006 |
| KR | 10-2010-0035865 | A | 4/2010 |
| KR | 20-2011-0003353 | U | 4/2011 |
| KR | 10-2011-0100327 | A | 9/2011 |
| KR | 101177000 | B1 * | 8/2012 |

* cited by examiner

HAIR ACCESSORY

FIELD OF THE INVENTION

The present disclosure relates to a hair accessory, and more particularly, to a hair accessory that is easy to wear on and removes from the hair, provides a stable fit, and is economical.

BACKGROUND OF THE INVENTION

In general, a hair band, or a hair tie, is used to tie the hair or prevent the hair from flowing down while improving the appearance, especially when the hair is long. However, since the conventional headband is made of rubber or spandex, it is difficult to wear and does not provide a luxurious aesthetic appearance.

Meanwhile, when a hair band is made of a precious metal such as gold to give a luxurious aesthetic appearance, it is difficult to create a structure that can be stably fixed to the hair due to insufficient rigidity.

In addition, since precious metals such as gold are relatively expensive, it is not economical.

DETAILED DESCRIPTION OF THE INVENTION

Technical Problems

An object of the present disclosure is to provide a hair accessory.

Another object of the present disclosure is to provide a hair accessory that is easy to wear and remove.

Another object of the present disclosure is to provide a hair accessory that provides a stable fit.

Another object of the present disclosure is to provide a hair accessory capable of separating and replacing a decoration part, which gives a luxurious aesthetic feeling but is relatively expensive.

SUMMARY OF THE INVENTION

A hair accessary according to the present disclosure comprises: a body part including a first body part and a second body part capable of being mutually separated from and coupled to each other; a first decoration part covering at least a portion of an outer surface of the first body part; and a second decoration part covering at least a portion of an outer surface of the second body part; wherein the body part has an inner surface having a closed loop structure formed through coupling of the first body part and the second body part.

Each of the first body part and the second body part may include one end and the other end, wherein at each of the one end, the first body part and the second body part may be rotatably coupled to each other with respect to an axis, wherein at each of the other end, the first body part and the second body part may be engaged with and coupled to each other and form the inner surface having the closed loop structure of the body part, by rotation of the first body part and the second body part with respect to the axis in a state in which the first body part and the second body part are coupled to each other at the one end.

The inner surface of the closed loop structure of the body part may include a groove formed along a longitudinal direction.

The groove may be exposed to the outside in a state in which the first decoration part and the second decoration part are coupled to the first body part and the second body part, respectively.

The hair accessary may further comprise an elastic part having an elongated shape and coupled to the groove of the body part.

A width of the elastic part may be greater than a width of the groove.

The elastic part may include a portion having a relatively smaller thickness than other parts, in a central part in a longitudinal direction.

The first body part and the second body part may be made of surgical steel.

The first decoration part and the second decoration part may be slidingly coupled to the first body part and the second body part, respectively, in a state in which the first body part and the second body part are separated from each other.

The first decoration part and the second decoration part may be made of gold or silver and include outer surfaces exposed to the outside when worn by a user.

TECHNICAL EFFECTS OF THE INVENTION

The hair accessory according to the present disclosure separates the body part for being fixed to the hair and the decoration part for giving an aesthetic appearance from each other, thereby providing ease of wearing and removal and stable fixing force through the body part and providing economic an advantage by enabling replacement of the decoration part as needed, which is formed with a precious metal for providing a main aesthetic feeling but relatively expensive to manufacture.

BEST MODES FOR THE INVENTION

Figure 1:
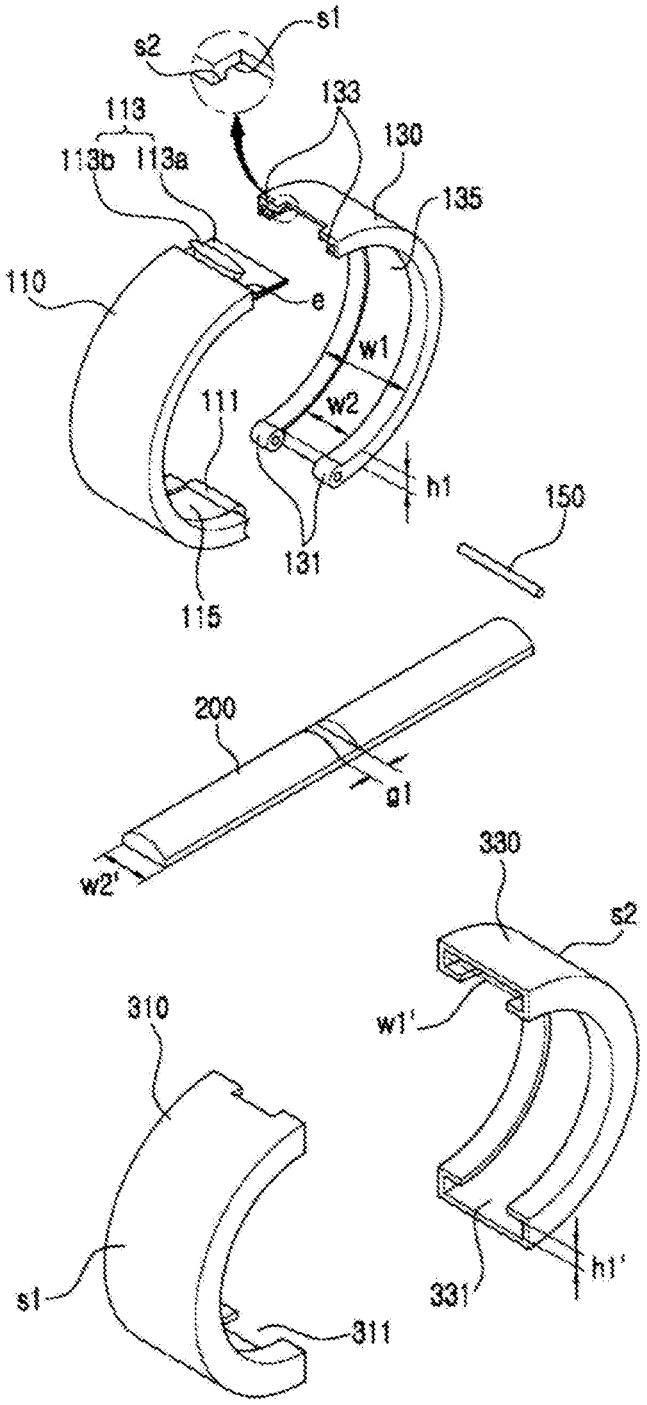
FIG. 1 is an exploded view of each component of a hair accessory according to the present disclosure.

Hereinafter, preferred embodiments of the present disclosure will be described in detail with reference to accompanying drawings and explanation to be described later. However, the present disclosure is not limited to the embodiments described herein and may be embodied in other forms. The embodiments introduced herein are provided so that the disclosure may be thorough and complete, and the spirit of the present disclosure may be sufficiently conveyed to those skilled in the art. Like reference numbers refer to like components throughout the description. Meanwhile, the terms used herein are used for the purpose of describing the embodiments and are not intended to limit the present disclosure.

In this description, the singular includes the plural unless otherwise specified in the phrase. In addition, terms "comprise" and/or "comprising" does not exclude one or more other components, steps, action, and/or elements other than the stated component, step, action, and/or element.

The hair accessory of the present disclosure is intended to be used when neatly tidying or tying a user's hair and comprises a body part made of metal, particularly surgical steel and a decoration part capable of being coupled to and separated from the body part and made of relatively expensive materials such as gold (Au) and silver (Ag). The hair accessory according to the present disclosure is convenient to use and provides a more luxurious appearance compared to conventional tools used for tying hair in the prior art, and at the same time, provides an economical advantage because a relatively expensive decoration part can be replaced.

A hair accessary according to the present disclosure comprises: a body part including a first body part and a second body part capable of being mutually separated from and coupled to each other; a first decoration part covering at least a portion of an outer surface of the first body part; and a second decoration part covering at least a portion of an outer surface of the second body part; wherein the body part has an inner surface having a closed loop structure formed through coupling of the first body part and the second body part.

In this case, each of the first body part and the second body part may include one end and the other end, wherein at each of the one end, the first body part and the second body part may be rotatably coupled to each other with respect to an axis, wherein at each of the other end, the first body part and the second body part may be engaged with and coupled to each other and form the inner surface having the closed loop structure of the body part, by rotation of the first body part and the second body part with respect to the axis in a state in which the first body part and the second body part are coupled to each other at the one end.

In this case, the inner surface of the closed loop structure of the body part may include a groove formed along a longitudinal direction.

In this case, the groove may be exposed to the outside in a state in which the first decoration part and the second decoration part are coupled to the first body part and the second body part, respectively.

In this case, the hair accessary may further comprise an elastic part having an elongated shape and coupled to the groove of the body part.

In this case, a width of the elastic part may be greater than a width of the groove.

In this case, the elastic part may include a portion having a relatively smaller thickness than other parts, in a central part in a longitudinal direction.

In this case, the first body part and the second body part may be made of surgical steel.

In this case, the first decoration part and the second decoration part may be slidingly coupled to the first body part and the second body part, respectively, in a state in which the first body part and the second body part are separated from each other.

In this case, the first decoration part and the second decoration part may be made of gold or silver and include outer surfaces exposed to the outside when worn by a user.

Hereinafter, a hair accessory according to the present disclosure will be described in detail with reference to the drawings.

Figure 2:
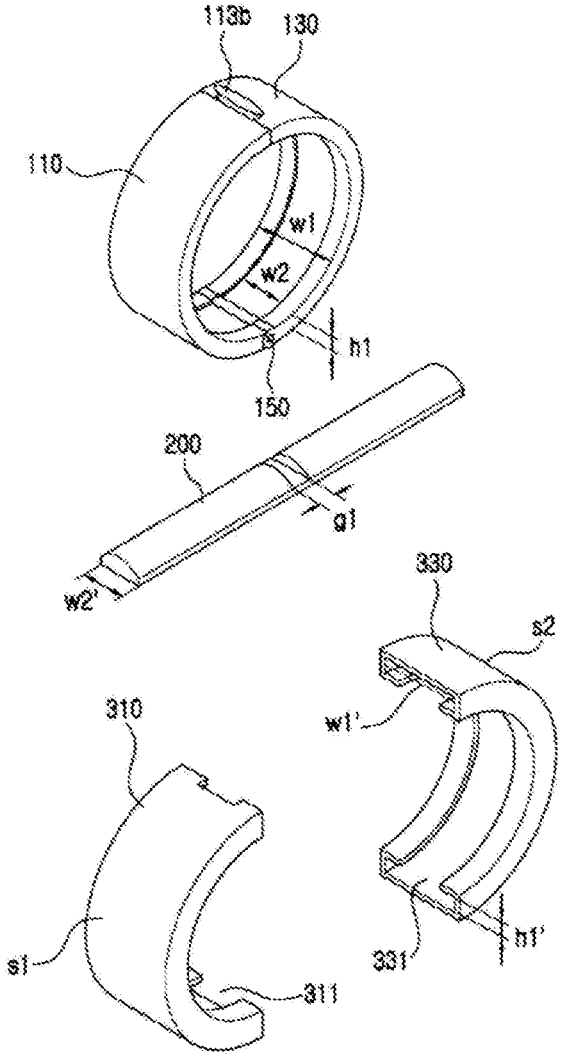
FIG. 2 is a view illustrating a state in which components of the body part in the exploded view of FIG. 1 are combined to each other.
Figure 3:
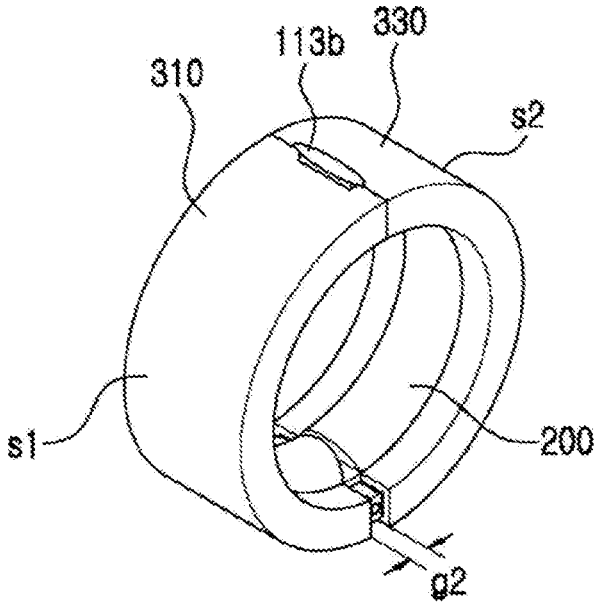
FIG. 3 is a view illustrating a state in which the components of the hair accessory are combined according to the present disclosure.

Referring to FIGS. 1 to 3, the hair accessory according to the present disclosure basically comprises: body parts 110, 130 and decoration parts 310, 330 that can be coupled to the body parts 110, 130. In addition, the hair accessory according to the present disclosure may further comprise an elastic part 200 that can be coupled to an inner surface of the body parts 110, 130.

Referring to FIGS. 1 and 2, the body parts 110, 130 include a first body part 110 and a second body part 130 that can be mutually coupled to and detachable from each other. The first body part 110 and the second body part 130 may each have a semicircular shape and may be coupled to each other to form the circular body parts 110, 130. However, the shapes of the first body part 110 and the second body part 130 are not limited to those shown in FIGS. 1 to 3, and various modifications are possible within the scope of the present disclosure. For example, the first body part 110 and the second body part 130 may each have a semi-elliptical or an angular "C" shape and may be coupled to each other to form an oval or a quadrangle.

The first body part 110 and the second body part 130 may be mutually coupled to and separated from each other, and for this structure, one end and the other end opposite to the one end of each of the first body part 110 and the second body part 130 may include coupling means.

First, the first body part 110 and the second body part 130 may be rotatably coupled to each other through one end of each. For example, referring to FIG. 1, the first body part 110 and the second body part 130 may be rotatably coupled to each other through first coupling means 111, 131, 150 of one ends thereof. As a specific example, one ends of the first body part 110 and the second body part 130 are rotatably coupled to each other in such a way that a hollow cylindrical structure 111 formed at one end of the first body part 110 is inserted between hollow cylindrical structures 131 formed at one end of the second body part 130, and a cylindrical shaft 150 is inserted into the hollows of the cylindrical structure 111 of the first body part 110 and the cylindrical structures 131 of the second body part 131, which are arranged in a line.

In addition, in a state in which the first body part 110 and the second body part 130 are rotatably coupled to each other through the first coupling means 111, 131, 150 with respect to an axis at one ends, the other ends of the first body part 110 and the second body part may rotate to face each other with respect to the axis of the first coupling means 111, 131, 150 and be coupled to each other through second coupling means 113, 133. For example, referring to FIG. 1, the other ends of the first body part 110 and the second body part 130 may be engaged with each other. For this structure, an insertion part 113*a* having a shape of "∠" and a button part 113*b* attached to an end e of an upper plate of the insertion part 113*a* may be formed at the other end of the first body part 110. Here, the "∠" shape of the insertion part 113*a* may be made of a material having strong elasticity and a restoring force, and thus the original shape of the insertion part 113*a* can be maintained for a long period of time even though pressing operations are repeatedly performed in the button part 113*b*. A receiving part 133 for accommodating the insertion part 113*a* may be formed at the other end of the second body part 130. As shown in FIG. 1, the receiving part 133 may be formed with steps s1 and s2, and accordingly, the inserting part 113*a* and the receiving part 133 are mutually coupled to each other in such a way that when the inserting part 113*a* is inserted into the receiving part 133, the end e of the upper plate of the inserting part 113*a* is in contact with and caught in the step s2 of the receiving part 133. Meanwhile, when the button part 113*b* of the insertion part 113*a* is pressed, the end e of the upper plate of the insertion part 113*a* goes down below the step s2, and the insertion part 113*a* can be separated from the receiving part 133 by a force pulling the second body part 130 and the first body part 110 to be away from each other.

Meanwhile, the first body part 110 and the second body part 130 may be made of metals. For example, the first body part 110 and the second body part 130 may be made of surgical steel. Surgical steel is a metal used for medical tools such as a surgical knife, a needle, and the like or for accessories such as a bracelet, an earring, and the like. Since surgical steel contains less nickel, it is inexpensive, has less allergic reactions, and has excellent durability and corrosion resistance.

A user using a hair accessory according to the present disclosure, in a state in which the decoration part is coupled thereto as described later, can wear the hair accessory on and remove it from the hair by using a method of coupling or separating the second coupling means 113, 133. The hair accessory according to the present disclosure may be suitable for a ponytail hairstyle. Accordingly, wearing and removal of the hair accessory according to the present disclosure is easier than conventional spandex or rubber headbands. In addition, since the body parts 110, 130 are made of a metal such as surgical steel, structural stability is high.

Referring to FIG. 2, the first body part 110 and the second body part 130 are coupled through the first coupling means 111, 131, 150 and the second coupling means 113, 133 and form a cylindrical shape consisting of the first body part 110 and the second body part 130. The cylindrical body parts 110, 130 have an inner surface and an outer surface. In particular, the inner surface of the body parts 110, 130 has a circular closed loop structure. In this case, it is obvious that a shape of the closed loop structure may vary according to that of the first body part 110 and the second body part 130. In addition, grooves 115, 135, which are recessed or have relatively low depths, may be formed on the inner surfaces of the body parts 110, 130. Referring to FIGS. 1 and 2, the grooves 115 and 135 may be formed in a central area of the inner surface of the body parts 110, 130 along a length direction.

The elastic part 200 may be fitted into the grooves 115 and 135 formed on the inner surface of the body parts 110, 130. The elastic part 200 may be made of a material having strong elastic and a restoring force such as rubber. As shown in FIGS. 1 and 2, the elastic part 200 may have a form of an elongated straight line. However, the shape of the elastic part 200 is not limited thereto. For example, the shape of the elastic part 200 may be a circularly curved shape for facilitating mounting on the body parts 110, 130. In addition, it is desired that a width w2' of the elastic part 200 is slightly larger than a width w2 of the grooves 115 and 135. For example, the width w2' of the elastic part 200 may be 1% to 10% larger than the width w2 of the grooves 115 and 135 according to a constituent material of the elastic part 200. The elastic part 200 may be fitted into the grooves 115 and 135 in a state in which the first body part 110 and the second body part 130 are coupled through the first coupling means 111, 131, 150, or alternatively, in a state in which the first body part 110 and the second body part 130 are completely coupled through the first coupling means 111, 131, 150 and the second coupling means 113, 133. It is desired that a thickness of the elastic part 200 is greater than depths of the grooves 115 and 5 135 formed on the inner surfaces of the body parts 110, 130. For example, the thickness of the elastic part 200 may be between 110% and 120% of the depths of the grooves 115 and 135. This structure is to allow the elastic part 200 disposed on the inner surface of the body parts 110, 130 to directly contact the user's hair and provide sufficient pressure on it, when the hair accessory according to the present disclosure is worn on the user's hair using the second coupling means 113,133 of the body parts 110, 130.

Meanwhile, since the hair accessory according to the present disclosure uses the second coupling means 113, 133 when worn on or removed from the user's hair, repeated rotational movements necessarily occur in the first coupling means 111, 131, 150. Accordingly, the elastic part 200 may undergo frequent stretching and contraction in a portion corresponding to a position of the first coupling means 111, 131, 150 of the body part 110, 130, and accordingly, a lifespan of the elastic part 200 may be shortened. In order to prevent this, the elastic part 200 may include a portion having a thinner thickness than other parts at a position corresponding to the position of the first coupling means 111, 131, 150 of the body part 110, 130. Referring to FIG. 1, the elastic means 200 may include a step in its central part. In this case, a width g1 of the gap may correspond to or larger than a width of the first coupling means 111, 131 of the body part 110, 130 in a state in which the first body part 110 and the second body part 130 are coupled to each other.

Since the hair accessory according to the present disclosure includes the elastic part 200 on the inner surface of the body parts 110, 130, when the hair accessory is worn on the user's hair, the elastic part 200 can directly contact the user's hair and provide pressure, thereby providing a more stable fit to the user. That is, according to the hair accessory of the present disclosure, the elastic part 200 may serve to prevent the hair accessory from falling down, or leaving off, from the user's hair.

Meanwhile, unlike the embodiment shown in FIGS. 1 to 3, according to another embodiment, the elastic part may consist of two parts, and each part may be coupled to the groove 115 of the first body part 110 and the groove 135 of the second body 130, respectively. According to this embodiment, it is possible to avoid a phenomenon that the elastic part is deteriorated near the first coupling means 111, 131.

The decoration parts 310, 330 may be coupled to the body parts 110, 130. The decoration parts 310, 330 may be coupled to the body parts 110, 130 made of a metal, thereby contributing to enhancing an aesthetic appearance of the hair accessory. The decoration parts 310, 330 may be made of, for example, a precious metal such as gold or silver.

Referring to FIGS. 1 to 3, the decoration parts 310, 330 may include a first decoration part 310 coupled to the first body part 110 and a second decoration part 310 coupled to the second body part 330. For example, the first decoration part 310 and the second decoration part 330 may have a semicircular shape similar to the first body part 110 and the second body part 130.

The first decoration part 310 may be coupled to the first body part 110 to cover at least a portion of an outer surface of the first body part 110 and at least a portion of the inner surface of the first body part 110. In addition, the second decoration 330 may be coupled to the second body 130 to cover at least a portion of an outer surface of the second body part 130 and at least a portion of the inner surface of the second body part 130. However, the first decoration part 310 and the second decoration part 330 should not cover the grooves 115, 135 of the inner surface of the body parts 110, 130, or the first body part 110 and the second body part 130. This structure is to allow the elastic part 200 to be easily fitted into and removed from the grooves 115 and 135.

The first decoration part 310 and the second decoration part 330 may be coupled to or separated from each other in a sliding manner in a state in which the first body part 110 and the second body part 130 are separated from each other.

Accordingly, the first and second decoration parts 310, 330 include insertion parts 311 and 331 each having a height h1' corresponding to a thickness h1 of each of the first and second body parts 110, 130, respectively, and having a width w1' corresponding to a width w1 of each of the first and second body parts 110, 130 110, 130. Referring to FIGS. 1 and 2, the first and second decoration parts 310, 330 include insertion parts 311 and 331, respectively, which are disposed and extended in a "C" shape to face to each other. One ends or the other ends of the first body part 110 and the second body part 130 may be fitted into the "C" shaped insertion parts 311 and 331 in a sliding manner.

The decoration parts 310, 330 have outer surfaces s1 and s2. Various decorations, shapes, and others may be added to the outer surfaces s1 and s2 of the decoration parts 310, 330 to enhance the aesthetic appearance of the hair accessory.

According to the hair accessory of the present disclosure, the decoration parts 310, 330, which provide the main aesthetic appearance but have a relatively high manufacturing cost, are provided separately from the body parts 110, 130, which provide the main structure. This structure provides economic advantages because precious metals such as gold can be applied only to exposed parts. That is, only the decoration parts, not the body parts, are made of a precious metal. In addition, the structural stability of the hair decoration part can be improved through a structure in which the decoration parts 310, 330 having relatively weak hardness are coupled to the body parts 110, 130 having relatively high hardness. Furthermore, the decoration parts 310, 330 providing the main aesthetic appearance can be removed and replaced from the body parts 110, 130, and the user can use the hair accessary with different aesthetic appearances by coupling the decoration parts 310, 330 having a different aesthetic feeling as needed.

The embodiments described above are provided only for illustrative purposes and not for limiting the scope of the present invention. In addition, those skilled in the art of the present disclosure will understand that various embodiments are possible within the scope of the technical spirit of the present disclosure.

MODES FOR THE INVENTION

Modes for the invention have been described along with the best modes for the invention described above.

INDUSTRIAL APPLICABILITY

The present invention can be easily worn on and removed from the hair and can provide a stable fit, thereby providing industrial applicability.

What is claimed is:

1. A hair accessary comprising:

a body part including a first body part and a second body part capable of being mutually separated from and coupled to each other;

a first decoration part covering at least a portion of an outer surface of the first body part; and a second decoration part covering at least a portion of an outer surface of the second body part;

wherein the body part has an inner surface having a closed loop structure formed through coupling of the first body part and the second body part, wherein each of the first body part and the second body part includes one end and an other end, wherein at each of the one end, the first body part and the second body part are configured to be rotatably coupled to each other through a first coupling means with respect to an axis of the first coupling means, wherein at each of the other end, the first body part and the second body part are configured to be engaged with and coupled to each other through a second coupling means and form the inner surface having the closed loop structure of the body part, by rotation of the first body part and the second body part with respect to the axis of the first coupling means in a state in which the first body part and the second body part are coupled to each other at the one end, wherein the second coupling means comprises:

an insertion part having a shape of an angle symbol and being made of a material having elasticity and a restoring force, a button part attached to an end of an upper plate of the insertion part, and a receiving part for accommodating the insertion part, wherein the insertion part and the button part are formed at the other end of the first body part and the receiving part is formed at the other end of the second body part, wherein the receiving part comprises upper and lower steps; and the insertion part and the receiving part are configured to be mutually coupled to each other in such a way that when the insertion part is inserted into the receiving part, the end of the upper plate of the insertion part is in contact with and caught in the lower step of the receiving part and when the button part is pressed, the end of the upper plate of the insertion part goes down below the lower step, and the insertion part is separated from the receiving part by a force pulling the second body part and the first body part to be away from each other.

2. The hair accessary of claim 1, wherein the inner surface of the closed loop structure of the body part includes a groove formed along a longitudinal direction.

3. The hair accessary of claim 2, wherein the groove is exposed to an outside in a state in which the first decoration part and the second decoration part are coupled to the first body part and the second body part, respectively.

4. The hair accessary of claim 3, further comprising an elastic part having an elongated shape and coupled to the groove of the body part.

5. The hair accessary of claim 4, wherein a width of the elastic part is greater than a width of the groove.

6. The hair accessary of claim 4, wherein the elastic part includes a portion having a smaller thickness than thickness of a remaining portion of the elastic part, in a central part in a longitudinal direction.

7. The hair accessary of claim 1, wherein the first body part and the second body part are made of surgical steel.

8. The hair accessary of claim 1, wherein the first decoration part and the second decoration part are slidingly coupled to the first body part and the second body part, respectively, in a state in which the first body part and the second body part are separated from each other.

9. The hair accessary of claim 1, wherein the first decoration part and the second decoration part are made of gold or silver and include outer surfaces exposed to an outside when worn by a user.

* * * * *